US008905727B2

(12) United States Patent
Frey et al.

(10) Patent No.: US 8,905,727 B2
(45) Date of Patent: Dec. 9, 2014

(54) ISOLATED PRESSURE COMPENSATING ELECTRIC MOTOR CONNECTION AND RELATED METHODS

(75) Inventors: Jeffrey G. Frey, Broken Arrow, OK (US); Ryan P. Semple, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 174 days.

(21) Appl. No.: 13/553,176

(22) Filed: Jul. 19, 2012

(65) Prior Publication Data

US 2013/0040480 A1 Feb. 14, 2013

Related U.S. Application Data

(60) Provisional application No. 61/522,555, filed on Aug. 11, 2011.

(51) Int. Cl.

| | |
|---|---|
| ***F04B 35/04*** | (2006.01) |
| ***H01R 25/00*** | (2006.01) |
| ***H02K 11/00*** | (2006.01) |
| ***F04B 47/06*** | (2006.01) |

(52) U.S. Cl.

CPC ..... *F04B 47/06* (2013.01)
USPC ..... 417/414; 417/423.2; 417/424.1; 439/289; 439/824; 310/71

(58) Field of Classification Search

CPC ..... F04D 13/10; F04D 13/08; F04D 7/065; F04B 53/164
USPC ..... 417/414, 423.3, 424.1, 424.2, 439; 310/71, 87; 439/289, 700, 824
See application file for complete search history.

(56) References Cited

U.S. PATENT DOCUMENTS

| | | | | |
|---|---|---|---|---|
| 7,789,689 | B2 | 9/2010 | Frey et al. | |
| 7,857,604 | B2 | 12/2010 | Shaw et al. | |
| 2006/0160430 | A1 * | 7/2006 | Siddiqi et al. | 439/700 |
| 2009/0010773 | A1 * | 1/2009 | Parmeter et al. | 417/410.1 |
| 2009/0068037 | A1 * | 3/2009 | Shaw et al. | 417/422 |

* cited by examiner

*Primary Examiner* — Devon Kramer
*Assistant Examiner* — Christopher Brunjes
(74) *Attorney, Agent, or Firm* — Bracewell & Giuliani LLP

(57) ABSTRACT

Isolated pressure compensating electrical motor connections and related methods are provided. According to an example of a sealed motor electrical connection, the connection incorporates a sealed female motor connection positioned to receive a male motor connector. The female motor connector has one or more independent dielectric oil chambers each pressure compensated by a bellow or similar device interfaced with the motorhead oil and/or well annulus fluid to thereby pressure compensate the chamber pressure of the female motor connection with that of the internal motor and/or well annulus. This configuration locates the electrical connection point of the motor lead extension with the motor lead wires to a separate area outside the motor to thereby prevent the occurrence of phase to phase or phase to ground shorts occurring in this critical area due to conductive element contamination that may reside in the motor oil or the well bore fluids.

20 Claims, 11 Drawing Sheets

ISOLATED PRESSURE COMPENSATING ELECTRIC MOTOR CONNECTION AND RELATED METHODS

RELATED APPLICATIONS

This application is a non-provisional patent application of and claims priority to and the benefit of U.S. Patent App. No. 61/522,555, filed on Aug. 11, 2011, titled "Hermetically Sealed Motor Electrical Connection and Related Methods," incorporated by reference in its entirety.

BACKGROUND OF THE INVENTION

1. Field of the Invention

This invention relates in general to a subterranean connector for use in a wellbore. More particularly, the present invention is directed to a connector used to provide power to a submersible motor. Yet more particularly, the present invention provides a electrical submersible pump connector configured to be pressure compensated.

2. Description of the Related Art

A common type of electrical submersible pump comprises a centrifugal pump suspended on a string of tubing within a casing of the well. The pump is driven by a downhole electrical motor, normally a three-phase AC type. A power line extends from a power source at the surface alongside the tubing to the motor to supply power.

Typically the power line is made up of two sections, an external motor lead (external to the motor) and a power cable. The external motor lead has a plug on its lower end known as a "pothead" that secures to a receptacle known as a "pothole" at the upper end of the electrical motor. The external motor lead typically has three conductors that are insulated and located within a single elastomeric jacket that is extruded around the assembled insulated conductors. Metallic outer armor may wrap around the jacket of the external motor lead to avoid damage to the motor lead while running the pump assembly into the well. The external motor lead extends upward beyond the pump, for example, from 10 to 80 ft. The total of the external motor lead and pothead is known as the motor lead extension (MLE). The lead could exceed 80 ft or be shorter than 10 ft depending on the application. A splice connects the external motor lead to the power cable. The external motor lead is flat and smaller in dimension than the power cable so that it can pass between the pump assembly and the casing.

The power cable typically comprises three conductors, each having one or more layers of insulation. An elastomeric jacket is usually extruded over the assembled conductors. In some cases, the insulated conductors are encased in lead. The insulated conductors are arranged either in a flat side-by-side configuration, or in a round configuration spaced 120 degrees apart from each other relative to a longitudinal axis of the power cable. A metallic armor is typically wrapped around the jacket to form the exterior of the power cable.

In some wells, the formation pressures are quite high and can vary, causing a significant differential in pressure between the internal pressure of the motor and the internal pressure of the pothead and/or pothead connector. Therefore, it would be beneficial to have a motor electrical connection design that is operable to compensate for internal differential pressure between the connector in the motor.

SUMMARY OF THE INVENTION

In view of the foregoing, various embodiments of the present invention advantageously provide a sealed motor electrical connection and methods of employing the sealed motor electrical connection.

More specifically, an example of an embodiment of a motor lead extension-to-motor lead connector apparatus includes a hermetically sealed pothead connection positioned in a chamber forming an independent dielectric oil reservoir. According to the exemplary configuration, this oil reservoir is pressure compensated by a metal bellow or similar device to either the internal motor or the well annulus pressure. According to the exemplary configuration, the chamber can be packaged in a couple of different configurations relative to the motor. These exemplary configurations strive to support various objectives including moving the 3 connection points to positions as far away from each other as possible to thereby increase the tracking distances. One option is to make 3 separate chambers that could be mounted on the outer diameter (OD) of the head of the motor spaced up to 120 degrees apart. Another option is to package each of these 3 connection points in a separate device that could be placed between the motor head and seal section to accommodate electrical connections and pressure compensation elements. Another option is to package each of these three connection points inside the "pothead" of a motor lead extension (MLE).

According to an exemplary configuration, this chamber can be pressure compensated and isolated from the motor oil and well fluid in order to serve as a controlled environment where the connection from the power cable (i.e., MLE) to the motor's lead wires will occur. According to an exemplary configuration, the motor-side of the chamber can use compression fittings or the like to seal against the stator lead wires which extends through the motor housing. The compression fitting will isolate the dielectric motor oil and keep it from entering into the connector chamber. According to an exemplary configuration, the female side of a plug-in connection is located on the opposite side of the connector chamber. This can be of similar construction to a wet-mate connector.

According to the exemplary configuration, a shuttle pin will shift inside the connector to engage the male plug to the female receptacle. According to this configuration, when a connection is made, this spring-loaded shuttle pin will be wiped through two sealing glands which house independent dielectric oil chambers. Advantageously, the separate dielectric oil chambers can use two different densities of dielectric oil or grease in the chambers to prevent cross contamination therebetween. It should be noted that this connection point is where non-insulated points of high electrical potential reside. The connector apparatus advantageously provides a means to keep this area in a state of high dielectric strength and physically isolated to prevent electrical shorts to either of the adjacent phases and to prevent the connectors from seeking ground.

According to an exemplary configuration, the conductors of the MLE are contained in steel tubing and the ends are sealed with compression fittings and terminated to a male plug (e.g., modified pothead). This plug can have a typical spin collar (like a feed-thru penetrator) that threads onto the housing of the female portion of the connector.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
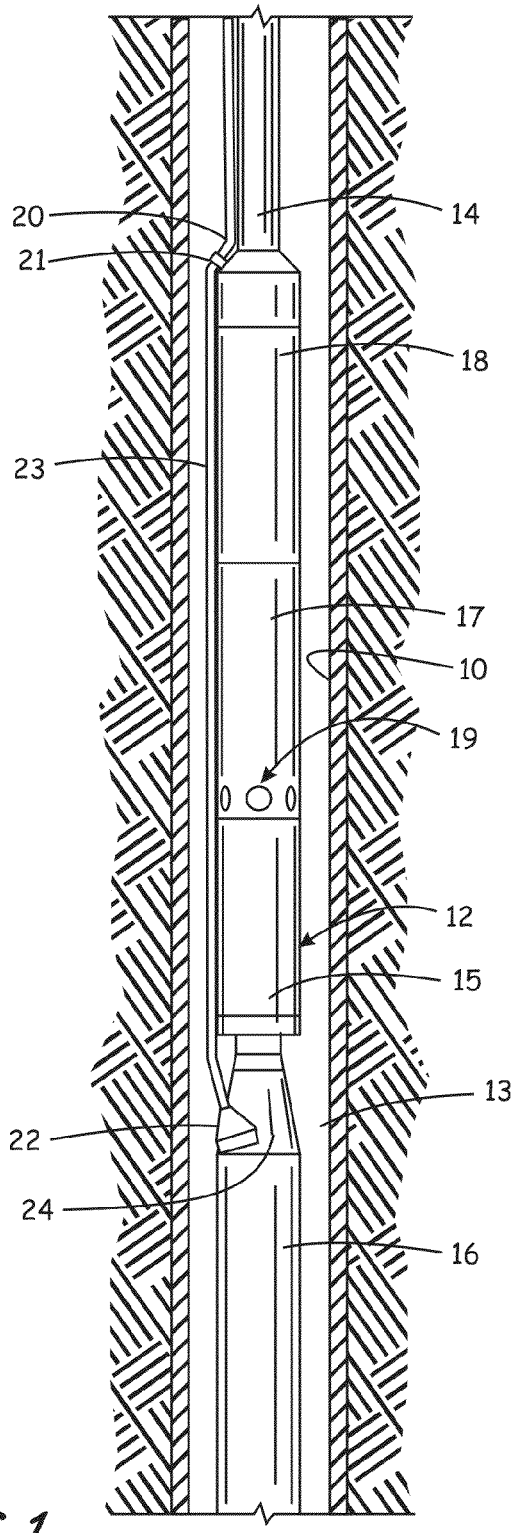
FIG. 1 is an environmental view of an electrical submersible pump disposed in a well bore according to an embodiment of the present invention.

FIG. 1 is an elevational section view of well bore 10 having electrical submersible pumping system (ESP) 12 disposed therein. The space between the outer surfaces of the ESP 12 and the well bore 10 define a well annulus 13. ESP 12 includes an electric motor 16, a seal/equalizer section 15, an optional separator 17, and a pump 18. The pump 18 may comprise a centrifugal pump or a progressing cavity pump, for example. Fluid inlets 19 shown on separator 17 provide a passage for receiving fluid into ESP 12. Production tubing 14 is coupled to pump 18 discharge for conveying pressurized production fluid from the ESP 12 to the surface. Cable 20 extends downhole, terminating in a connector 21 that electrically couples cable 20 to a motor lead extension 23. According to the embodiment illustrated in FIG. 1, the motor lead extension 23 is a single conductor or multiple conductors contained within a single sheath. According to another embodiment, the motor lead extension 23 can be multiple separate conductors. The motor lead extension 23, on its lower terminal end, connects to an external motor connector apparatus 22 that electrically connects and secures the motor lead extension 23 to the motor housing of the motorhead 24 of electric motor 16. In another embodiment, cable 20 can extend all the way from the surface to the external motor connector 22, thereby eliminating the need for connector 21.

Figure 2:
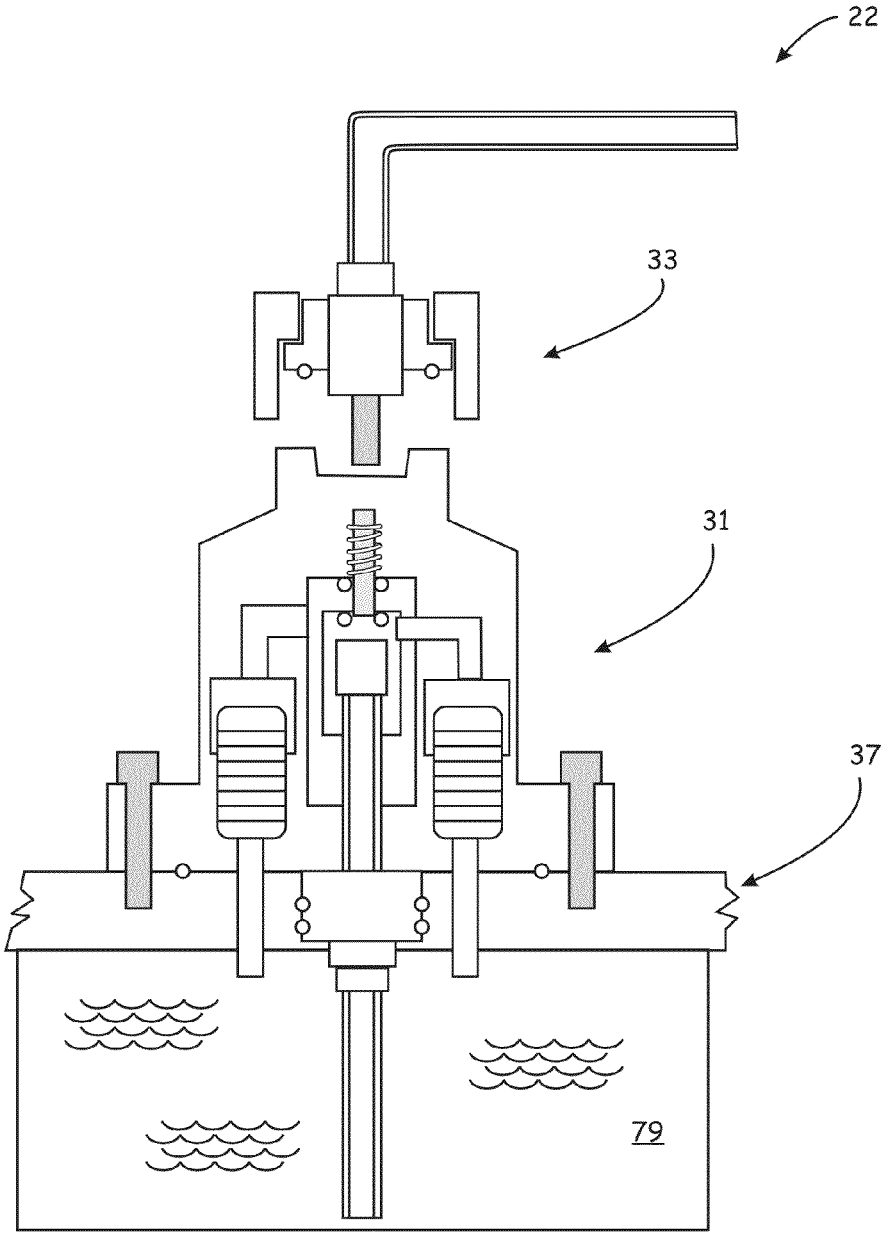
FIG. 2 is a sectional view of an apparatus to connect a motor lead extension to a motor lead to supply electric power to an electrical submersible pump motor according to an embodiment of the present invention.

FIG. 2 illustrates a more detailed view of an embodiment of the external motor connector apparatus 22. According to an embodiment, the apparatus 22 is provided in two major parts: female motor connector 31 and a male motor lead extension connector 33 shown spaced apart prior to connection to the female motor connector 31.

Figure 3:
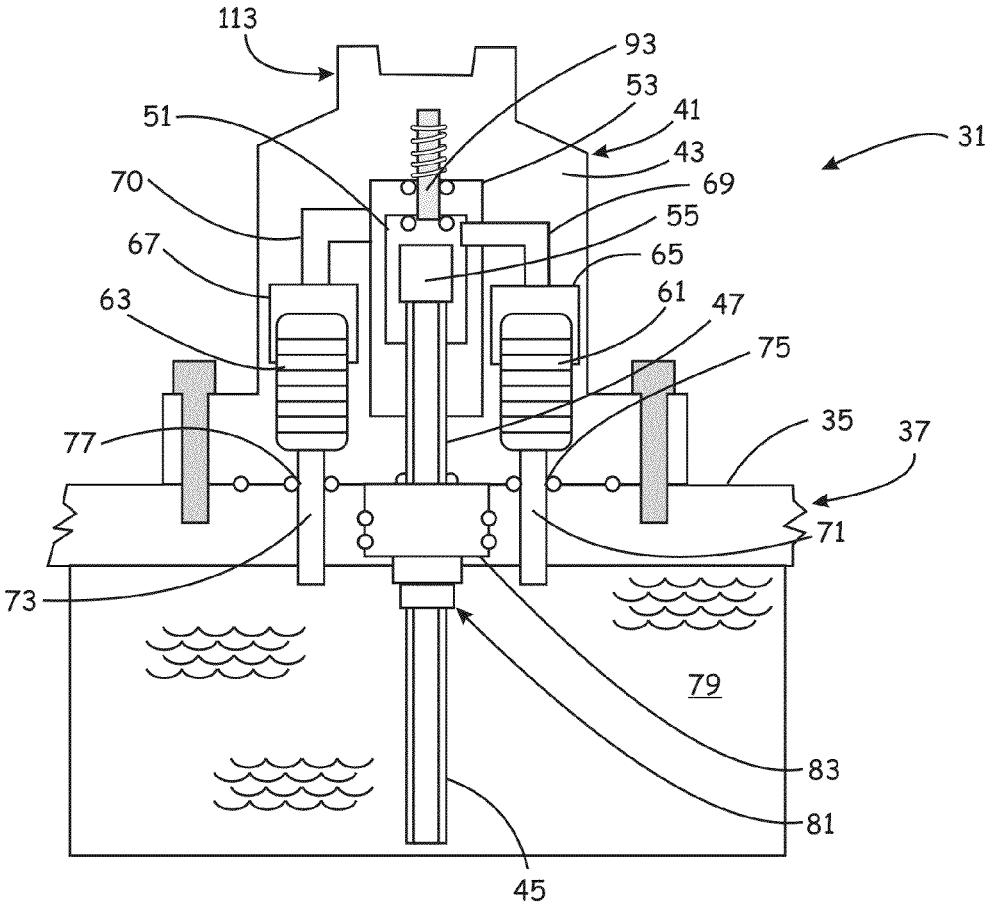
FIG. 3 is a sectional view of a female motor connector portion of an apparatus to connect a motor lead extension to a motor lead according to an embodiment of the present invention.

FIG. 3 illustrates an example of the female motor connector 31 shown connected to an outer surface 35 of a motorhead wall, wall of a protrusion on the motorhead, or other form motor housing, collectively referred to as motor housing 37 of the motor 16. According to an exemplary configuration, the female motor connector 31 includes a housing 41. The housing 41 is positioned in a surrounding relationship to a portion 47 of a motor lead 45 of the motor 16 extending externally through the motor housing 37 to thereby contain the external portion 47 of the motor lead 45.

According to the exemplary configuration, at least one, but more preferably two barrier oil chambers 51, 53, are contained within the housing 41 and provide two independent isolated dielectric oil reservoirs. As shown in the figure, barrier oil chamber 51 surrounds and is sealed about a female terminal, also referred to as an electrical contact, 55 at the end of the external portion 47 of the motor lead 45 to contain the female terminal 55 in its isolated dielectric oil reservoir. The barrier oil chamber 53 surrounds the barrier oil chamber 51 surrounding the female terminal 55 to provide a second layer of isolation within its isolated dielectric oil reservoir. Note, although each of the chambers are described as containing a dielectric oil, one of ordinary skill in the art would recognize that other dielectric fluids can be utilized which would not necessarily be classified as an oil to include, but not limited to dielectric greases.

According to the exemplary configuration, each dielectric oil reservoir is pressure compensated by a pressure compensation device such as, for example, a metal bellow or bellows 61, 63, or other device having a similar function, such as, for example, a balancing piston or pistons, which extend into secondary dielectric oil reservoirs 65, 67. Dielectric oil surrounding the bellows 61, 63 is in fluid communication with the barrier oil chambers 51, 53 through passageways 69, 70. As shown in FIG. 3, each of the bellows 61, 63 include a conduit 71, 73, which extend through corresponding orifices 75, 77, in the outer surface 35 of the motor housing 37 in order to receive and discharge motor oil 79 contained within motor housing 37.

Figure 4:
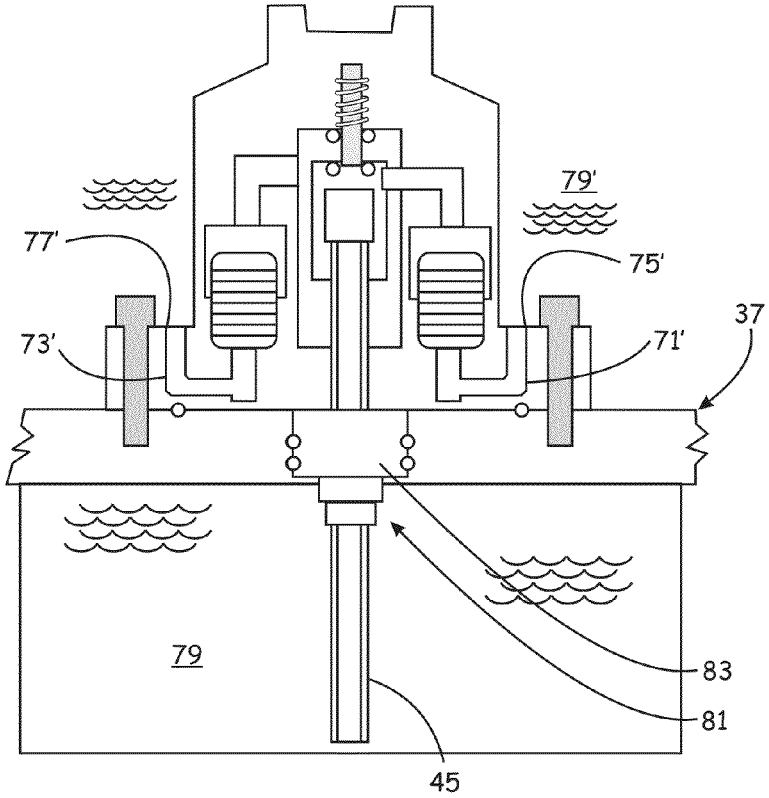
FIG. 4 is a sectional view of a female motor connector portion of an apparatus to connect a motor lead extension to a motor lead according to an embodiment of the present invention.

Alternatively, as shown in FIG. 4, conduits 71', 73', instead extend through corresponding orifices 75', 77', in the housing 41 of the female motor connector 31 to receive and discharge well annulus fluid 79'. Note, in both arrangements, seals as known to those of ordinary skill in the art are provided which prevent encroachment of either motor oil 79 or well fluid 79'.

According to an exemplary configuration, each of chambers 51, 53, are pressure compensated and isolated from the motor oil 79 and well fluid 79' in order to serve as a controlled environment where the connection from motor lead extension 23 to the motor's lead wires 47 will occur. According to an exemplary configuration, in order to prevent contamination of chamber 53 by motor oil 79 as a result of passage of the portion 47 of motor lead 45 into the chamber 53, compression fitting 81 or the like can be used to seal against the motor lead 45. The compression fitting 81, particularly when employed in conjunction with an I-block feed through 83, will function to isolate the motor oil 79 and keep it from entering into the connector chamber 53.

Figure 5:
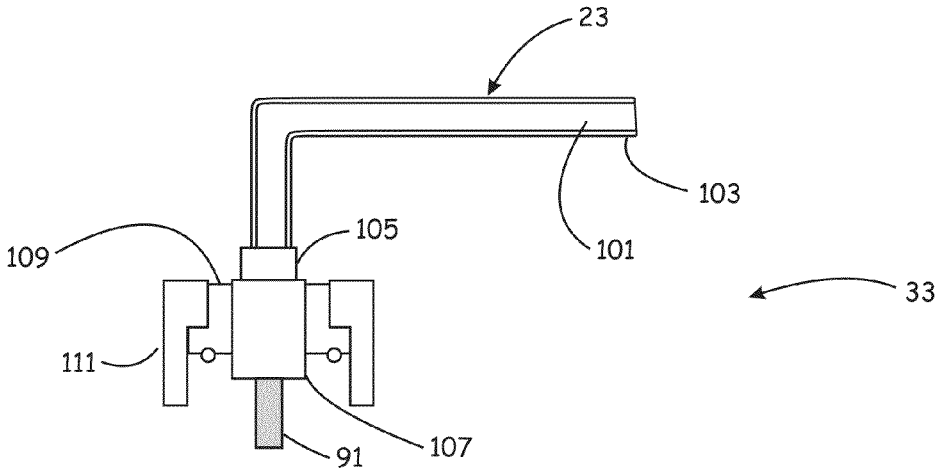
FIG. 5 is a sectional view of a male motor lead extension connector portion of an apparatus to connect a motor lead extension to a motor lead according to an embodiment of the present invention.

According to an exemplary configuration, a plug-in connection, which can be, for example, of similar construction to a wet-mate connector, is located on the top (distal) portion of the female motor connector 31. Referring to FIG. 5, the male motor lead extension connector 33 is configured to connect to the top portion of the female motor connector 31 According to the exemplary configuration, the male motor lead extension connector 33 includes a male pin 91 configured to engage the shuttle pin 93 (FIG. 3) to establish an electrical connection therebetween and to slidably position the shuttle pin 93 into engagement with the female terminal 55 as shown, for example, in FIG. 7.

Referring again to FIG. 5, according to an exemplary configuration, the male motor lead extension connector 33 connects with and terminates the motor lead extension 23. According to this configuration, the conductors 101 of the motor lead extension 23 are contained in steel tubing 103 and the ends are each sealed with a compression fitting 105 and terminated to a male plug (e.g., modified pothead) in the form of, e.g., an I-block feed-thru 107 encircled with a compression plate 109 or other metal seal. This plug can have a typical spin collar 111 (like a feed-thru penetrator) that threads onto a complementing portion 113 of the female motor connector 31.

Figure 6:
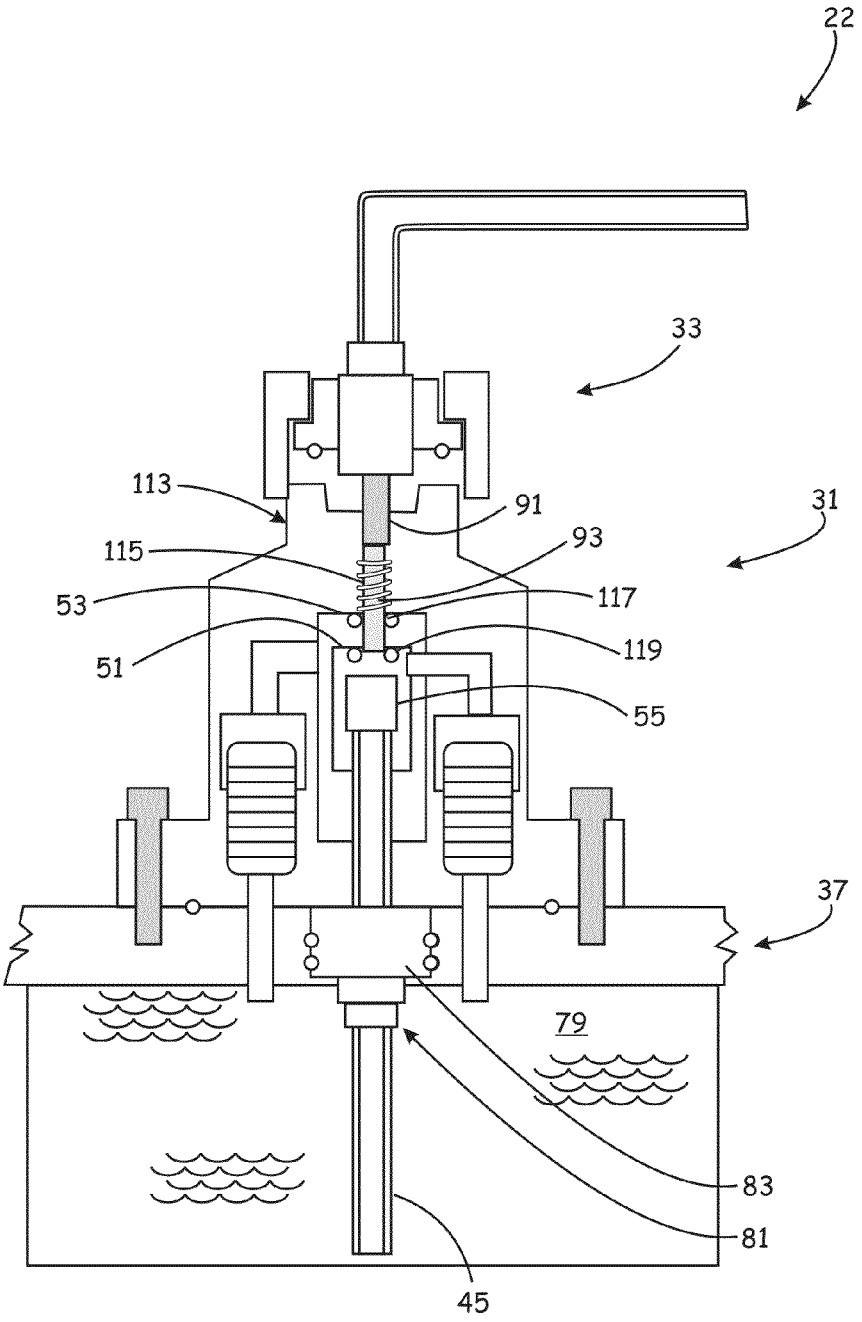
FIG. 6 is a sectional view of an apparatus to connect a motor lead extension to a motor lead illustrating initial engagement of a male motor lead extension connector with a female motor connector according to an embodiment of the present invention.
Figure 7:
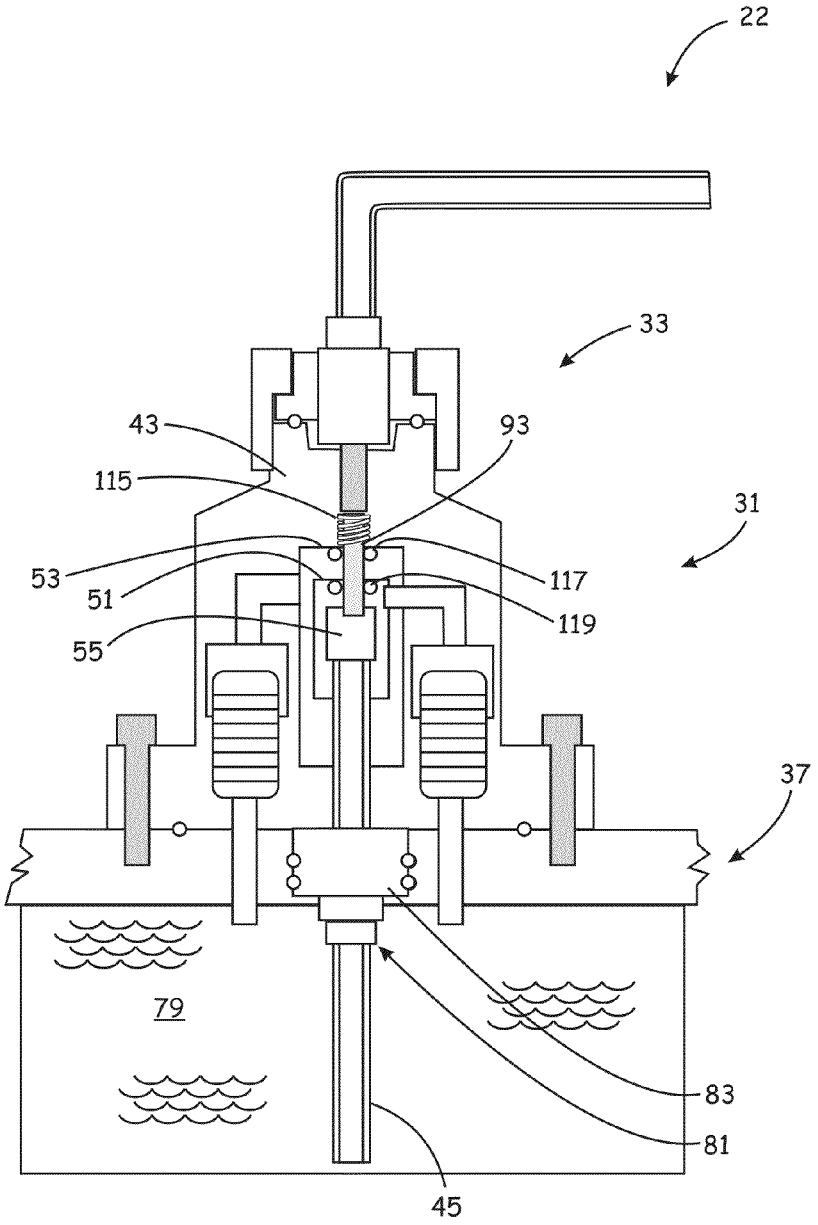
FIG. 7 is a sectional view of an apparatus to connect a motor lead extension to a motor lead illustrating complete engagement of a male motor lead extension connector with a female motor connector according to an embodiment of the present invention.

Referring to FIGS. 6 and 7, according to the exemplary configuration, upon engagement by the male pin 91, the shuttle pin 93 will shift further inside the female motor connector 31 to thereby electrically couple the male motor lead extension connector 33 to the female terminal 55. As shown in FIG. 6, according to this configuration, when a connection is made between the male pin 91 and the spring-loaded shuttle pin 93, spring 115 will begin to compress and as best shown in FIG. 7, the shuttle pin 93 will be wiped through the sealing gland 117 of barrier oil chamber 53 and the sealing gland 119 of barrier oil chamber 51, which form independent dielectric oil chambers. This function continues until the male motor lead extension connector 33 is fully electrically engaged with female terminal 55 as illustrated in FIG. 7. Advantageously, the separate dielectric oil chambers 51, 53, can use different densities of dielectric oil or grease in the chambers to prevent cross contamination therebetween.

It should be noted that this male pin-shuttle pin connection point is where non-insulated points of high electrical potential reside. According to an exemplary configuration, the connector apparatus 22 provides a means to keep this area in a state of high dielectric strength and physically isolated to prevent electrical shorts to either adjacent phases and to prevent the connectors from seeking ground.

Advantageously, an embodiment of the present invention includes an embodiment of the apparatus 22 for connecting a motor lead extension 23 to a motor lead 45 that incorporates a hermetically sealed pothead connection in an independent dielectric oil reservoir 51, 53. This oil reservoir 51, 53, can be pressure compensated by a metal bellow 61, 63 (or similar device) to either the internal motor or well annulus pressure. This chamber 51, 53, can advantageously be packaged in a couple of different configurations relative to the motor 16. A common objective can include a goal of moving the 3 electrical connection points to connect to the motor 16 at a location as far away from each other as possible to increase the tracking distances. One option, according to an embodiment, is to make 3 separate female connection points 31 (see, e.g., FIG. 3) that can be mounted on the outer diameter of the head of the motor 16, spaced up to 120 degrees apart.

Figure 9:
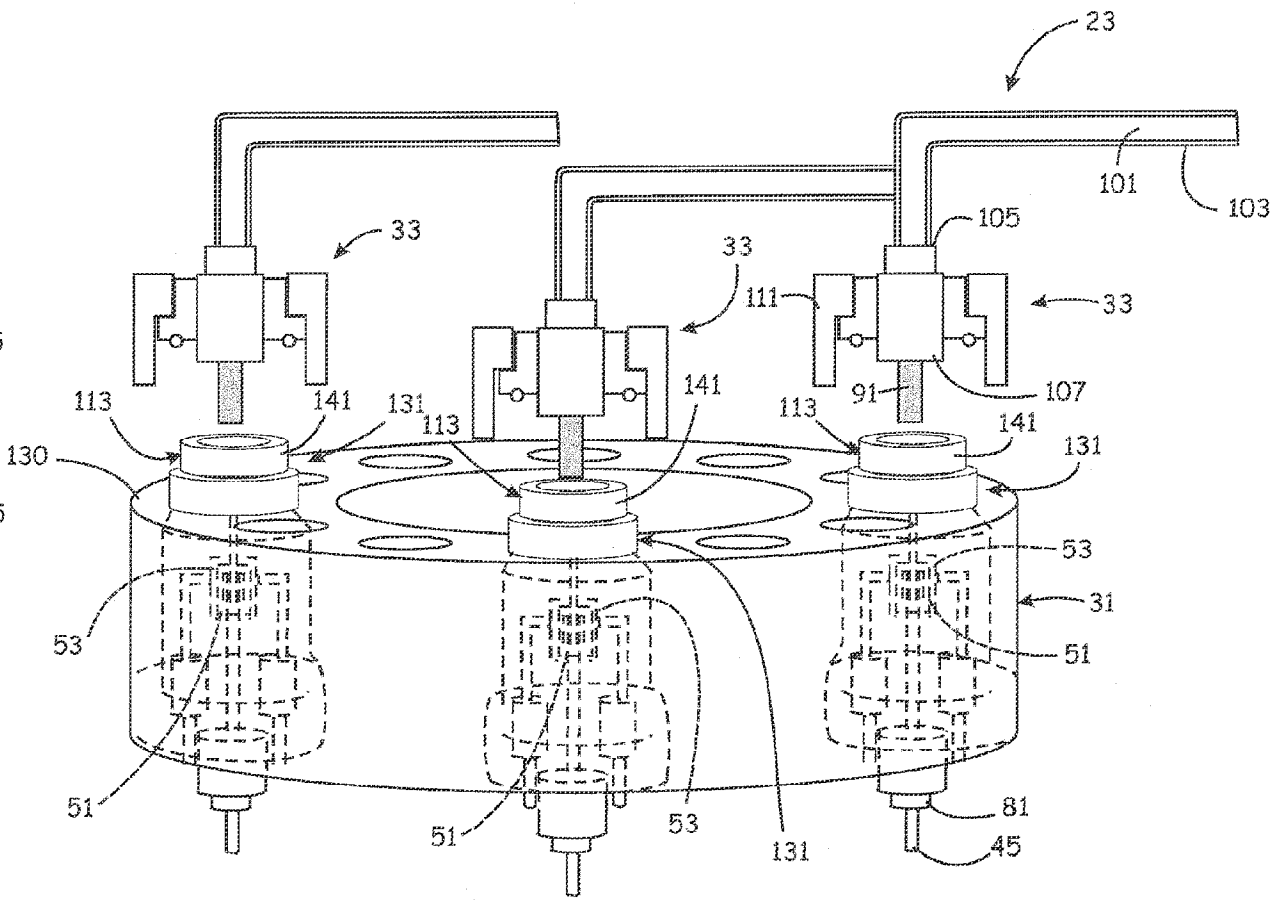
FIG. 9 is a part perspective part sectional view of a manifold-type female motor connector portion and male motor lead connection portion of an apparatus to connect a set of motor lead extensions to a corresponding set of motor leads according to an embodiment of the present invention.
Figure 8:
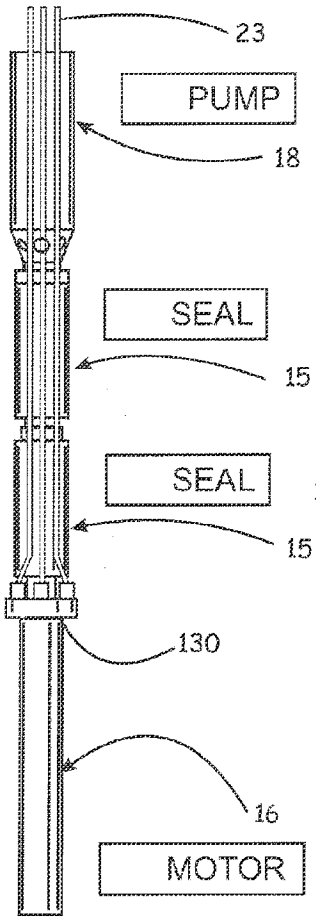
FIG. 8 is a part environmental perspective view of a manifold-type connection apparatus connected between the motorhead and seal section according to an embodiment of the present invention.

Referring to FIGS. 8 and 9, another option, according to an embodiment, is to package each of the 3 connection points 113 (see, e.g., FIG. 6) in a separate external connection device 130 placed between the motor 16 and seal section 15 to accommodate electrical connections and pressure compensation elements. The device 130 carries a plurality of female motor connectors 131 each containing chambers 51, 53, bellows 61, 63, and dielectric oil reservoirs 65, 67, in a similar configuration as that shown in FIG. 3. Chambers 51, 53, can be pressure compensated and isolated from the motor oil and well fluid in order to provide a controlled environment where the connection from the power cable motor lead extension 23 to the motor leads 45 occur. According to an embodiment, the motor-side of the device 130 can use three sets of compression fittings 81 or similar means to seal against stator lead wires 45 to isolate the dielectric motor oil 79 (see, e.g., FIG. 3) and keep it from entering into the chamber 53.

With reference to a single female motor connector 131, on the other side of the chamber 53 is where the female connection point 113 of a plug-in connection 131 is located. This can be of similar construction to a wet-mate connector where a shuttle pin 93 shifts inside the connector to engage the male plug/extension connector 33 to the female connection point 113 of the female motor connector 131. According to this embodiment, when a connection is made, a spring-loaded shuttle pin 93 (FIG. 6) is wiped through two sealing glands 117, 119, which house independent dielectric oil chambers 51, 53.

According to an embodiment, the chambers 51, 53, can use two different densities of dielectric oil or grease to prevent cross contamination. This electrical connection point (female terminal 55 with pin 93 engaged by pin 91) is where there are non-insulated points of high electrical potential reside. Advantageously, this configuration provides a means to keep this area in a state of high dielectric strength and physically isolated to prevent electrical shorts to either adjacent phases or to prevent the connectors from seeking ground. Note, this configuration can include the various configurations of pressure compensation devices or bellows 61, 63 and exchange conduits 71, 71', 73, 73' shown and described with respect to FIGS. 3 and 4, among others as known and understood by those of ordinary skill in the art.

According to an embodiment, the conductor 101 of the motor lead extension 23 is contained in steel tubing 103 and the ends can be sealed with compression fitting 105 and terminated to a male plug 107 encircled with a compression plate 109. This plug 107 can have a typical spin collar 111 (e.g., similar to a feed-thru penetrator) that threads onto the female connection point 113 on the housing 141.

Figure 11:
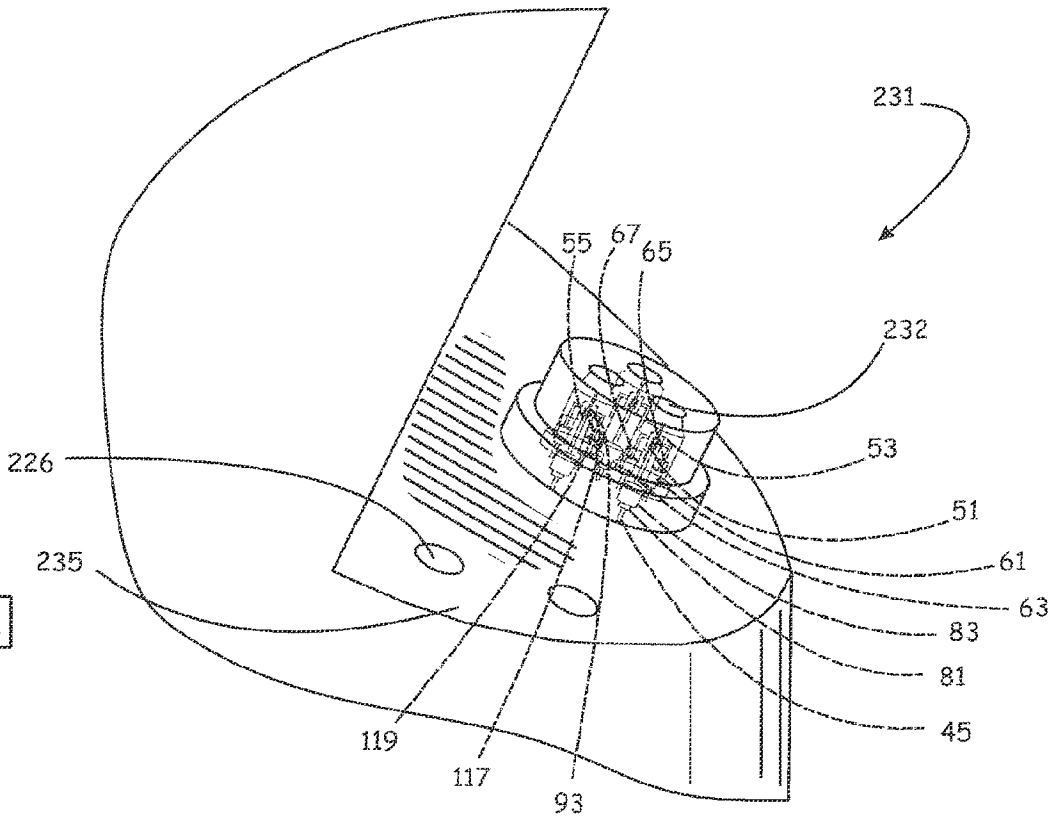
FIG. 11 is a perspective view of a plug-type female motor connector portion of an apparatus to connect a set of motor lead extensions to a corresponding set of motor leads according to an embodiment of the present invention.
Figure 10:
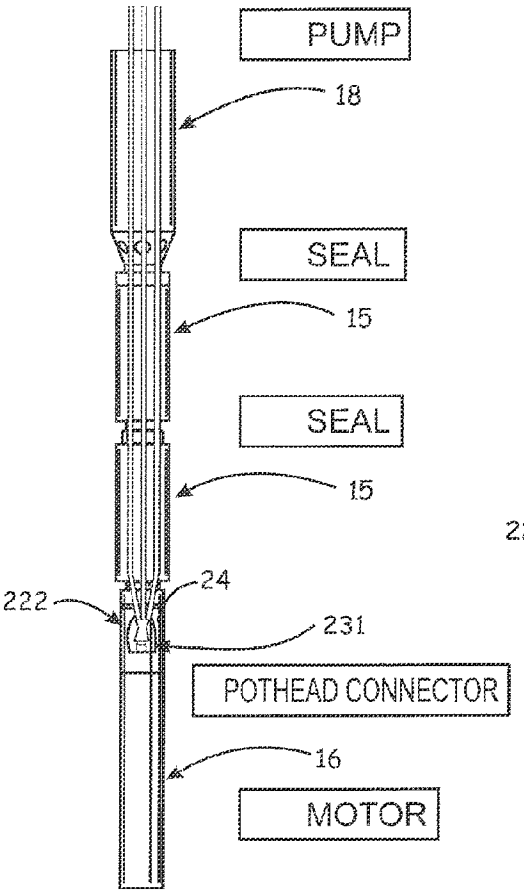
FIG. 10 is a part environmental perspective view of a plug-type motor connector apparatus to connect a set of motor lead extensions to a corresponding set of motor leads according to an embodiment of the present invention.
Figure 12:
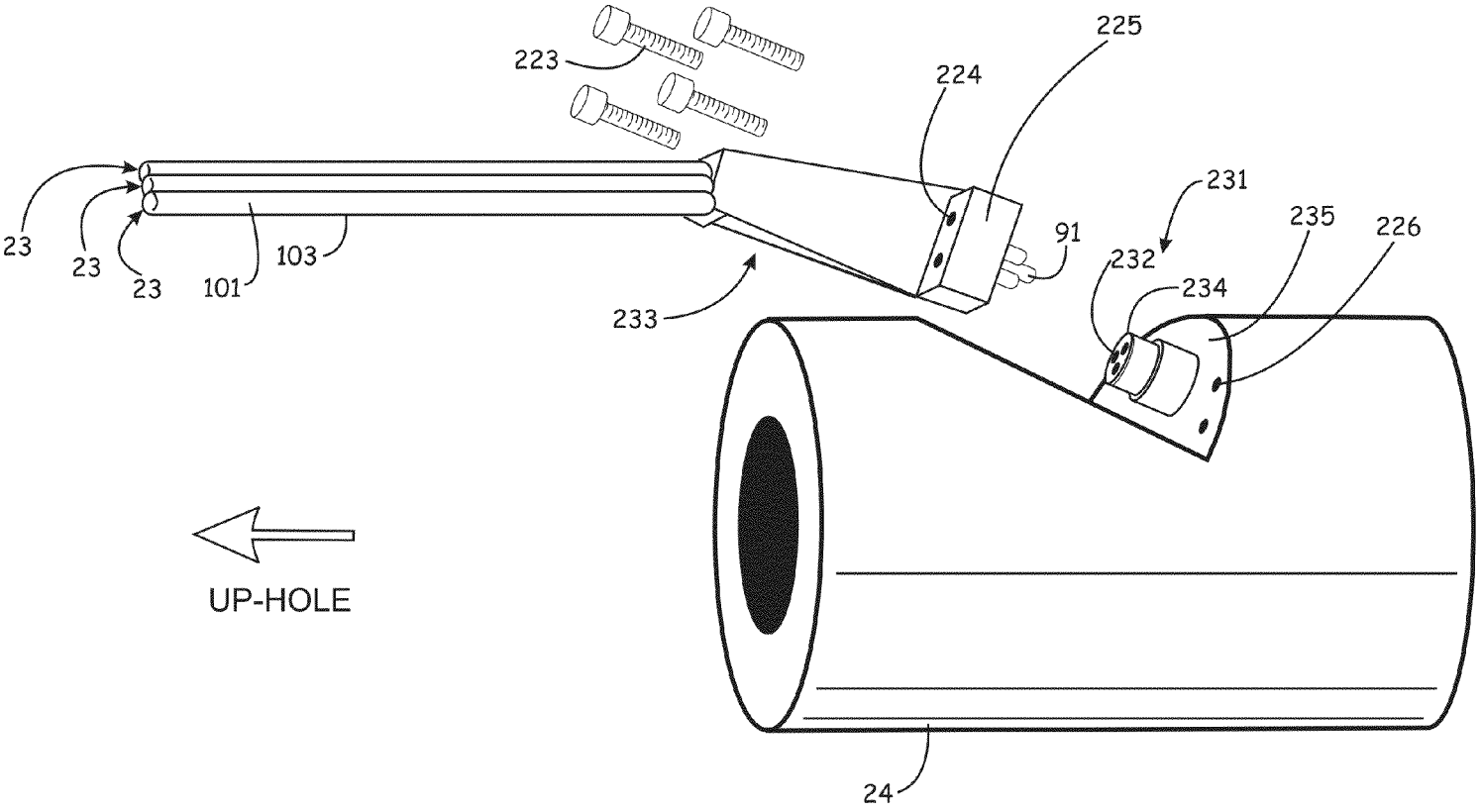
FIG. 12 is a part exploded perspective view of a plug-type female motor connector portion and male motor lead connection portion of an apparatus to connect a set of motor lead extensions to a corresponding set of motor leads according to an embodiment of the present invention.

Referring to FIGS. 10, 11, and 12, another option, according to an embodiment, is to package each of the three connection points in a single external female motor connection device 231 of an apparatus 222 to accommodate electrical connections and pressure compensation elements.

Primarily referring to FIG. 11, the device 231 carries a plurality of female motor connection ports 232, of which three are shown and provided in this exemplary embodiment. Each connection port 232, includes a corresponding plurality of sets of chambers 51, 53, bellows 61, 63, and dielectric oil reservoirs 65, 67, in a similar configuration as that shown in FIG. 3. Chambers 51, 53, can be pressure compensated and isolated from the motor oil and well fluid in order to provide a controlled environment where the connection from the power cable motor lead extension 23 to the motor leads 45 occur. According to an embodiment, the motor-side of the device 231 can use three sets of compression fittings 81 or similar means to seal against stator lead wires 45 to isolate the dielectric motor oil 79 (see, e.g., FIG. 3) and keep it from entering into chamber 51.

With reference to a single female motor connection, on the other side of the chamber 51 is where the female connection port 232 and associated connection components are located. This can be of similar construction to a wet-mate connector where a shuttle pin 93 shifts inside the connector to engage one of the plurality of pins 91 of an external motor lead extension connector apparatus 233 (FIG. 12) to the female connection port 232 of the female motor connector 231. According to this embodiment, when a connection is made, a spring-loaded shuttle pin 93 is wiped through two sealing glands 117, 119, which house independent dielectric oil chambers 51, 53.

According to an embodiment, the chambers 51, 53, can use two different densities of dielectric oil or grease to prevent cross contamination. This electrical connection point (female terminal 55 with pin 93 engaged by pin 91) is where there are non-insulated points of high electrical potential reside. Advantageously, this configuration provides a means to keep this area in a state of high dielectric strength and physically isolated to prevent electrical shorts to either adjacent phases or to prevent the connectors from seeking ground. Note, this configuration can include the various configurations of pressure compensation devices or bellows 61, 63 and exchange conduits 71, 71', 73, 73' shown and described with respect to FIGS. 3 and 4, among others as known and understood by those of ordinary skill in the art.

Primarily referring to FIG. 12, according to an embodiment, the motor lead extension connector apparatus 233 connects with a plurality of conductors 101 of a corresponding plurality of motor lead extensions 23. A plurality of pins 91 extend from the motor lead extension connector apparatus 233. According to an embodiment, the conductors 101 of the motor lead extension 23 are contained in steel tubing 103 and the ends are each sealed with a compression fitting and terminated to a male plug encircled with a compression plate or other metal seal as understood by those of ordinary skill in the art.

The motor lead extension connector apparatus 233 can include an annular seal circumscribing the entire set of pins 91 or can have individual seals circumscribing each of the pins 91 and can be sealed to a faceplate 234 surrounding each of the set of ports 232. A set of bolts or other fasteners 223 extend through a set of apertures 224 in a pair of flanges 225. The bolts or other fasteners 223 engage a corresponding set of apertures 226 in an outer surface 235 of the motorhead 24. Note, other connection and sealing configurations are within the scope of the present invention.

Figure 13:
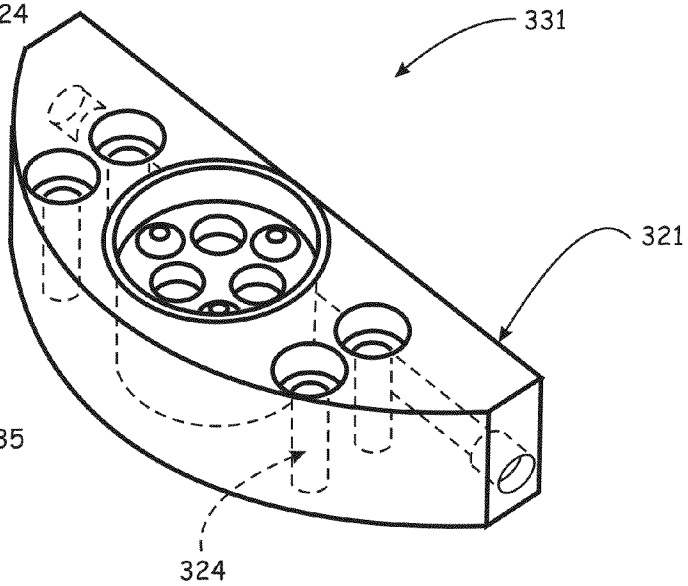
FIG. 13 is a perspective view of a plug-type female motor connector portion and connection housing providing for connection using conventional male plug connection apparatus according to an embodiment of the present invention.
Figure 14:
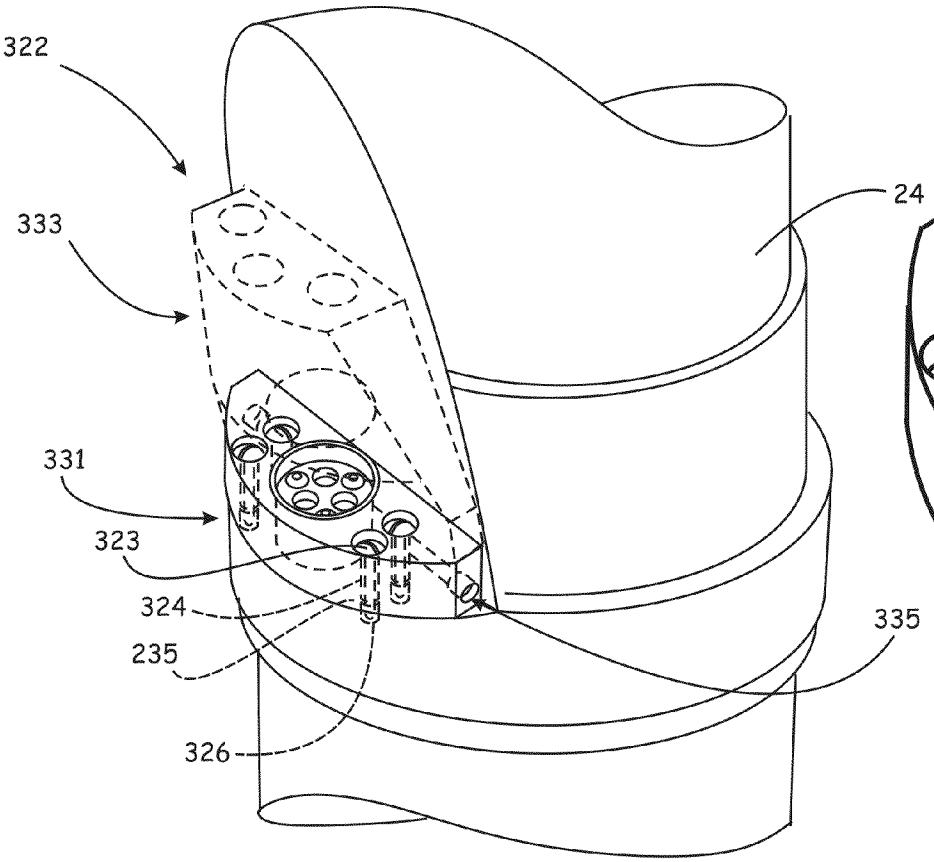
FIG. 14 is a perspective view illustrating connection of a conventional male plug to a plug-type female motor connector portion and connection housing of an apparatus according to an embodiment of the present invention.

FIG. 13 illustrates a plug-type female motor connector portion 331 of an apparatus 322 (FIG. 14) to connect a set of motor lead extensions 23 to a corresponding set of motor leads 45 and a connection housing 321 providing for connection using conventional male plug connection apparatus 333 according to an embodiment of the present invention. FIG. 14 illustrates the connection of the conventional male plug connector 333 to the plug-type female motor connector portion 331 and connection housing 321, with the male components not shown. A set of bolts or other fasteners 323 extend through a set of apertures 324 in the connection housing 321. The bolts or other fasteners 323 engage a corresponding set of apertures 326 in an outer surface 235 of the motorhead 24. Port 335 is a port exposed to well flowing fluid which acts on a balancing piston to serve as another pressure compensating device similar in function to 61 & 63.

Referring primarily to FIGS. 2-17, various embodiments of the present invention also include methods of connecting a motor lead extension 23 to a motor lead (45, 47) to supply electric power to an electrical submersible pump motor 16. An example of such a method includes the step of providing an electrical submersible pump assembly having a motor 16 contained within a motor housing 37 and configured to drive the submersible pump 18. The motor 16 typically contains a motor lead 45 within the motor housing 37. According to the exemplary configuration, however, a portion 47 of the motor lead 45 is made to extend externally through the motor housing 37. Seals prevent leakage of motor oil 79 along the inner diameter of the orifice providing a passageway for the external portion 47 of the motor lead 45.

The steps also include providing a female motor connector 31 including a housing 41 containing chambers 51, 53 filled with dielectric oil. The female motor connector 31 is configured to connect to the motor housing 37. Chambers 51, 53 are configured to envelop and contain the portion 47 of the motor lead 45 extending through the motor housing 37.

The steps correspondingly include connecting the female motor connector 31 to an outer surface portion of the motor housing 37 surrounding the portion 47 of the motor lead 45 extending through the motor housing 37 to thereby isolate the portion 47 of the motor lead 45 within the chamber 43.

According to an exemplary embodiment, the steps can also include positioning a pressure compensation device 61, 63 at least substantially within the housing 41 of the female motor connector 31. The pressure compensation device 61, 63 can take the form of bellows which can inflate or deflate in response to fluid entering or exiting the device.

According to the exemplary configuration shown in FIG. 3, the steps correspondingly can include positioning the pressure compensation device 61, 63 in fluid communication with motor oil 79 contained within the motor housing 37 to thereby pressure compensate the dielectric fluid contained within the female motor connector 31 to the motor oil 79 contained within the motor housing 37. According to an alternative configuration shown in FIG. 4, the steps can instead include positioning the pressure compensation device 61, 63 in fluid communication with well fluid 79' flowing within a well annulus 13 to thereby pressure compensate the dielectric fluid contained within the female motor connector 31 to the well fluid 79'. According to another alternative configuration shown in FIGS. 13 and 14, a balancing piston can be used in place of or in addition to pressure compensation devices 61, 63.

According to the exemplary configuration, the steps can also include positioning a first barrier oil chamber 53 within a housing 41 and positioning a second barrier oil chamber 51 within the first barrier oil chamber 53 to receive and contain the female terminal 55 on the distal-most end of the portion 47 of the motor lead 45 extending through the housing 37 of the motor 16. In the exemplary configuration, the first barrier oil chamber 53 spatially surrounds an contains barrier oil chamber 51.

The pressure compensation device 61 is further positioned to interface with the barrier oil chamber 51 so that, using the bellows example, when the device inflates, fluid pressure is applied to the dielectric fluid contained within barrier oil chamber 51. Similarly, the pressure compensation device 63 can be positioned to interface with barrier oil chamber 53 so that, using the bellows example, when the device inflates, fluid pressure is applied to the dielectric fluid contained within barrier oil chamber 53. The opposite, is of course true for when the devices 61, 63 are deflated due to a higher pressure exerted on the external surfaces of the device 61, 63, than that applied internally via either the motor oil 79 or the well fluid 79'.

According to the exemplary embodiment, the steps also include positioning a shuttle pin 93 within the housing 41 and configuring the shuttle pin 93 to slidably extend through the first and second barrier oil chambers 51, 53 to engage the female terminal 55 in response to engagement by a male pin 91. Correspondingly, the steps also can include connecting a male motor lead extension connector 33 to a distal portion of the female motor connector 31, engaging the shuttle pin 93 with the male pin 91 of the male motor lead extension connector 33 as shown in FIGS. 6 and 7. The engagement between male pin 91 and shuttle pin 93 is performed to establish an electrical connection therebetween and to establish an electrical connection between the shuttle pin 93 and the female terminal 55 in response to slidable engagement of the male pin 91 with the shuttle pin 93 during connection of the male motor lead extension connector 33 to the female motor connector 31 to provide electrical current to the motor 16 via isolated connections.

Various embodiments of the present invention provide several advantages. For example, according to an embodiment of the present invention the physical conductor junction between the electrical power cable and the motor's lead wires are located in a protected chamber located on, in, or near the motor head. Advantageously, this chamber is isolated from the well fluids and the motor oil preventing contamination from internal and external environments. This chamber is also pressure compensated to the well bore pressure through a metal bellows or similar system, for example. According to an embodiment, this apparatus can incorporate a chamber that uses compression fittings or something similar to seal against stator lead wires, which isolates the dielectric motor oil and the connection system. Advantageously, this chamber can facilitate a wet-mate style, dual dielectric oil sealing electrical connection system. When the male and female connections are plugged together, the male connection engages a spring loaded shuttle pin which is wiped through two oil filled chambers to make the connection with a female terminal. Advantageously, the separate chambers can use two different densities of dielectric oil or grease to prevent cross contamination.

According to an embodiment, the conductors of the motor lead extension are contained in steel tubing and the ends are sealed with compression fittings and terminated to the male plug/connector. This plug can have a typical spin collar (like a feed-thru penetrator) that threads onto the female connection point on the chamber. This chamber can house the connection points of the 3 phases as far away from each other as possible. The chamber can alternatively be 3 separate chambers mounted on the outer diameter of head of the motor up to 120 degrees apart. Another option includes the incorporation of a manifold placed between the motor head and seal to accommodate connection separation and pressure compensation.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A submersible well pump assembly, comprising:

a pump;

an electrical motor cooperatively connected with the pump for driving the pump, the motor having a motor housing that is filled with a dielectric motor lubricant, the motor having an internal motor lead immersed in the motor lubricant;

a seal/equalizer section mounted to the motor, the seal/equalizer section being in fluid pressure communication with the motor lubricant and with well fluid surrounding the motor for reducing a pressure difference between the motor lubricant and the well fluid surrounding the motor;

a female motor connector comprising a connector housing containing at least one chamber, the female motor connector being connected to an outer surface portion of the motor housing, the chamber being filled with a female motor connector dielectric fluid; wherein said at least one chamber comprises an inner chamber and an outer chamber containing the inner chamber; the female motor connector dielectric fluid comprises an inner dielectric fluid in the inner chamber and an outer dielectric fluid in the outer chamber; the inner dielectric fluid is sealed from the outer dielectric fluid;

at least one female pressure compensation device mounted to the female motor connector and in fluid pressure communication with the at least one chamber for reducing a pressure difference between the female motor connector dielectric fluid and the well fluid surrounding the motor;

the internal motor lead extending from within the motor housing into the at least one chamber and having an electrical contact on an end within the at least one chamber;

a power cable having at least one conductor to supply electrical power to the motor;

a male motor lead connector on an end of the power cable, the male motor lead connector being releasably secured to the female motor connector;

at least one of the conductors of the power cable extending into the female motor connector housing and electrically mating with the electrical contact of the internal motor lead when the male motor lead connector is secured to the female motor connector; and a seal around the internal motor lead that seals the motor lubricant from the dielectric fluid in the at least one chamber.

2. The assembly according to claim 1, further comprising:

a conduit extending from the pressure compensation device to an interior of the motor for communicating pressure of the motor lubricant to the pressure compensation device; and wherein the conduit bypasses the seal.

3. The assembly according to claim 1, wherein:

said at least one pressure compensation device comprises:

a inner pressure compensation device in fluid communication with the dielectric fluid in the inner chamber; and a outer pressure compensation device in fluid communication with the dielectric fluid in the outer chamber.

4. The assembly according to claim 1, wherein said at least one pressure compensation device comprises:

a inner pressure compensation device in fluid communication with the dielectric fluid in the inner chamber;

a outer pressure compensation device in fluid communication with the dielectric fluid in the outer chamber; and at least one conduit extending through the motor housing, bypassing the seal, and to the inner and the outer compensation devices, the conduit communicating motor lubricant from within the motor to the inner and outer compensation devices.

5. The assembly according to claim 1, further comprising:

a spring biased shuttle pin having an end located within the chamber prior to and following the connection of the male motor lead connector with the female motor connector, the shuttle pin electrically engaging the electrical contact on the internal motor lead with the conductor when the male motor lead connector is connected to the female motor connector housing.

6. The assembly according to claim 1, further comprising:

a shuttle pin positioned within the chamber and slidably mounted to the female motor connector between an engaged position having an inner end engaging the electrical contact of the internal motor lead, and a disengaged position with the inner end disengaged from the electrical contact of the internal motor lead, the inner end of the shuttle pin being located in the chamber before and after connection of the male motor lead connector to the female motor connector;

a spring urging the shuttle pin to the disengaged position; and wherein the conductor of the power cable engages and moves the shuttle pin to the engaged position in response to connecting the male motor lead connector to the female motor connector.

7. The assembly according to claim 6, further comprising:

a seal extending around the shuttle pin that seals the shuttle pin to the female motor connector and blocks entry of well fluid into the chamber.

8. An electrical submersible pump assembly, comprising:

a pump;

an electrical motor for driving the pump, the motor having a motor housing that is filled with a dielectric motor lubricant, the motor having an internal motor lead immersed in the motor lubricant;

a seal/equalizer section mounted to the motor, the seal/equalizer section being in fluid pressure communication with the motor lubricant and with well fluid surrounding the motor for reducing a pressure difference between the motor lubricant and the well fluid surrounding the motor;

a female motor connector comprising a housing containing an inner chamber located within an outer chamber, each of the chambers being filled with a female motor connector dielectric fluid, the female motor connector dielectric fluid in the inner chamber being isolated from the female motor connector dielectric fluid in the outer chamber and from the motor lubricant, the female motor connector being connected to an outer surface portion of the motor housing;

the motor lead extending sealingly through an aperture in the motor housing, sealingly through a portion of the outer chamber, and sealingly into the inner chamber, the motor lead terminating in an electrical contact within the inner chamber;

at least one pressure compensation device mounted to the female motor connector in fluid pressure communication with the female motor connector dielectric fluid contained in the inner and outer chambers, for reducing a pressure differential between the dielectric fluid contained in the inner and outer chambers and the well fluid surrounding the motor;

a power cable having at least one conductor to supply electrical power to the motor;

a male motor lead connector on an end of the power cable, the male motor lead connector being releasably secured to the female motor connector; and at least one of the conductors of the power cable extending from the male motor lead connector into the female motor connector housing and into electrical engagement with the electrical contact on the end of the motor lead within the inner chamber when the male motor lead connector is secured to the female motor connector, the conductor being in electrical disengagement with the electrical contact on the end of the motor lead when the male motor lead connector is disengaged from the female motor connector.

9. The assembly according to claim 8, further comprising:

a conduit extending from the pressure compensation device to an interior of the motor for communicating pressure of the motor lubricant to the pressure compensation device.

10. The assembly according to claim 8, wherein:

said at least one pressure compensation device comprises:

a inner pressure compensation device in fluid communication with the dielectric fluid in the inner chamber; and a outer pressure compensation device in fluid communication with the dielectric fluid in the outer chamber.

11. The assembly according to claim 8, wherein said at least one pressure compensation device comprises:

a inner pressure compensation device in fluid communication with the dielectric fluid in the inner chamber;

a outer pressure compensation device in fluid communication with the dielectric fluid in the outer chamber; and at least one conduit extending through the motor housing to the inner and the outer compensation devices, the conduit communicating motor lubricant from within the motor to the inner and outer compensation devices.

12. The assembly according to claim 8, wherein said at least one pressure compensation device comprises:

a inner pressure compensation device in fluid communication with the dielectric fluid in the inner chamber;

a outer pressure compensation device in fluid communication with the dielectric fluid in the outer chamber; and at least one well conduit communicating well fluid to the inner and the outer compensation devices.

13. The assembly according to claim 8, further comprising:

a spring biased shuttle pin having an inner end with an electrical contact in the inner chamber prior to and following connection of the male motor lead connector with the female motor connector, the inner end of the shuttle pin contacting the electrical contact of the internal motor lead while the male motor lead connector is connected to the female motor connector housing.

14. The assembly according to claim 8, further comprising:

a shuttle pin sealingly and slidably positioned within a shuttle pin passage in the female motor connector, the shuttle pin having an inner end within the inner chamber and an outer end recessed within the shuttle pin passage;

the shuttle pin having an engaged position with the inner end of the shuttle pin engaging the electrical contact of the internal motor lead;

the shuttle pin having a disengaged position with the inner end disengaged from the electrical contact of the internal motor lead;

a spring urging the shuttle pin to the disengaged position; and wherein the conductor of the male motor lead connector engages the outer end of the shuttle pin to move the shuttle pin to the engaged position when the male motor lead connector is connected to the female motor connector.

15. The assembly according to claim 14, wherein the shuttle pin also extends sealingly through a portion of the outer chamber.

16. A method of connecting a power cable to a submersible well pump assembly comprising a pump, an electrical motor for driving the pump, the motor having a motor housing that is filled with a dielectric motor lubricant, the motor having an internal motor lead immersed in the motor lubricant, and a seal/equalizer section mounted to the motor, the method comprising:

providing a female motor connector comprising a connector housing containing at least one chamber, filling the chamber with a female motor connector dielectric fluid, and connecting the female motor connector to an outer surface portion of the motor housing; providing the connector housing with at least one chamber comprises providing an outer chamber and an inner chamber located within the outer chamber; filling the chamber with a female motor connector dielectric fluid comprises filling each of the chambers with a dielectric fluid and isolating the dielectric fluid of the inner chamber from the dielectric fluid in the outer chamber;

providing the female motor connector with at least one pressure compensation device and placing the pressure compensation device in fluid pressure communication with the dielectric fluid in the chamber;

providing the internal motor lead with an electrical contact on an end, extending the internal motor lead from within the motor housing into the chamber, positioning the electrical contact in the chamber, and sealing the motor lead to the motor housing to isolate the motor lubricant in the motor housing from the dielectric fluid in the chambers;

providing a power cable having at least one conductor and a male motor lead connector on an end of the power cable, and releasably securing the male motor lead connector to the female motor connector;

in response to securing the male motor lead connector to the female motor connector, electrically engaging one of the conductors of the power cable with the electrical contact of the internal motor lead within the chamber; then lowering the assembly into the well, communicating well fluid pressure to the seal/equalizer section, and reducing a pressure difference between the motor lubricant and the well fluid surrounding the motor; and communicating well fluid pressure to the pressure compensation device and reducing a pressure difference between the dielectric fluid in the chamber and the well fluid surrounding the motor.

17. The method according to claim 16, wherein:

providing the female motor connector with at least one pressure compensation device comprises providing an inner pressure compensator for the inner chamber and an outer pressure compensator for the outer pressure compensator.

18. The method according to claim 16, wherein:

extending the internal motor lead from within the motor housing into the chamber comprises extending the internal motor lead sealingly through a portion of the outer chamber and sealingly into the inner chamber.

19. The method according to claim 16, wherein:

communicating well fluid pressure to the pressure compensation device comprises communicating motor lubricant from the motor housing to the pressure compensation device.

20. The method according to claim 16, wherein:

providing a female motor connector further comprises mounting a shuttle pin within the female motor connector, the shuttle pin having an inner end within the inner chamber and an outer end sealed from the inner and outer chambers; and in response to securing the male motor lead connector to the female motor connector, engaging the outer end of the shuttle pin with the conductor and moving the shuttle pin inward, electrically engaging the inner end of the shuttle pin with the electrical contact on the internal motor lead.

* * * * *

UNITED STATES PATENT AND TRADEMARK OFFICE

CERTIFICATE OF CORRECTION

PATENT NO. : 8,905,727 B2
APPLICATION NO. : 13/553176
DATED : December 9, 2014
INVENTOR(S) : Jeffrey G. Frey et al.

It is certified that error appears in the above-identified patent and that said Letters Patent is hereby corrected as shown below:

In the Specification
Column 1, line 19, delete "a" before "electrical" and insert -- an --
Column 5, line 18, delete "are" and insert -- is --

In the Claims
Column 12, line 48, Claim 10, delete "a" before "inner" and insert -- an --
Column 12, line 50, Claim 10, delete "a" before "outer" and insert -- an --
Column 12, line 54, Claim 11, delete "a" before "inner" and insert -- an --
Column 12, line 56, Claim 11, delete "a" before "outer" and insert -- an --
Column 12, line 64, Claim 12, delete "a" before "inner" and insert -- an --
Column 12, line 66, Claim 12, delete "a" before "outer" and insert -- an --

Signed and Sealed this
Twenty-third Day of June, 2015

Michelle K. Lee

Michelle K. Lee
*Director of the United States Patent and Trademark Office*